United States Patent [19]

Beretta

[11] Patent Number: 4,614,096

[45] Date of Patent: Sep. 30, 1986

[54] SYSTEM FOR THE CONTINUOUS AND OPEN-WIDTH WASHING OF A FABRIC

[75] Inventor: Mario Beretta, Gerenzano, Italy

[73] Assignee: Arioli & C S.R.L., Gerenzano, Italy

[21] Appl. No.: 665,921

[22] Filed: Oct. 29, 1984

Related U.S. Application Data

[63] Continuation of Ser. No. 190,563, Sep. 25, 1980, abandoned.

[30] Foreign Application Priority Data

Oct. 1, 1979 [IT] Italy ..... 26161 A/79

[51] Int. Cl.[4] ..... D06F 1/02; D06F 3/20

[52] U.S. Cl. ..... 68/22 R; 68/158; 68/177; 68/184; 68/205 R; 68/207

[58] Field of Search ..... 68/205 R, 207, 158, 68/177, 181 R, 184, 22 R, 13 R

[56] References Cited

U.S. PATENT DOCUMENTS

| | | | |
|---|---|---|---|
| 862,233 | 8/1907 | Bernhardt | 68/158 X |
| 1,913,601 | 6/1933 | Leppin | 68/205 R X |
| 2,724,955 | 11/1955 | Spooner | 68/158 |
| 3,579,679 | 5/1971 | Willis | 68/177 X |
| 3,886,769 | 6/1975 | Conti | 68/205 R X |
| 3,978,696 | 9/1976 | Ito et al. | 68/207 X |
| 4,070,878 | 1/1978 | Valls | 68/205 R X |
| 4,135,373 | 1/1979 | Conti | 68/205 R X |

FOREIGN PATENT DOCUMENTS

| | | | |
|---|---|---|---|
| 2353739 | 5/1975 | Fed. Rep. of Germany | 68/177 |
| 388290 | 2/1933 | United Kingdom | 68/158 |

*Primary Examiner*—Philip R. Coe

*Attorney, Agent, or Firm*—Bucknam and Archer

[57] ABSTRACT

Improved methods and treating units for the continuous and open width washing of textile products of manufacture, after the printing and/or purging and bleaching thereof, comprising advancing said textile product of manufacture through a treating environment, including a treating bath, on a permeable conveyor and under the control of liquid blades as supplied under recirculating conditions from the bath, with comparatively high flow rates and comparatively low pressures, in such a way that liquid jets provide a dynamic impact and heat entrainment action on the advancing material, material being preferably, while not necessarily, predisposed in laps on permeable conveyor.

3 Claims, 2 Drawing Figures

10
12
14
14a
14b
14c
16
18
20
22
24
26
28
30
32
34
36
38
38₁
38₂
38₃
40
42
44
46
48
50
52
54
56
58
62
6
T
T'
T''
T'f
G
L'
L''
A
B

SYSTEM FOR THE CONTINUOUS AND OPEN-WIDTH WASHING OF A FABRIC

This is a continuation of application Ser. No. 190,563, filed Sept. 25, 1980, and now abandoned.

The present invention relates to improvements in and/or related to the methods and systems for the continuous and open-width washing, after printing and/or purging, of standard and knitted fabrics, as thereinbelow described.

The technique related to these washings and the systems and equipment for carrying out said washings are already known in the art as exemplified by U.S. Pat. No. 3,968,664.

More specifically the improvement according to the invention is related to the washing process step which, according to the prior art, has been carried out by the system portion illustrated at 12 in the FIGS. 1 and 4 of said Italian Pat. No. 991,433, which system portion forms the so-called "storage and releasing unit", as it is well known in the art.

Accordingly it is possible to skip any further description of this prior art and directly proceed to the description of the features and characteristics of the method and system, in particular of said storage and releasing unit, according to the present invention.

According to the instant improvement, the fabric, which has been subjected to a printing treating or step, or which has not been so treated but processed in such a way as to be soaked in water, is advanced onto a conveyor permeable to the liquids, as installed in a closed environment or in an environment sufficiently closed to maintain within desirably low limits the heat losses, and containing a "bath" of chemical products in solution and/or aqueous dispersion, and effective to provide a cleansing and degreasing action. These products and the function whereof are well known in the art and comprise, for example, soaps, sodium hydroxide, hydrogen peroxide, sulphates and the like.

According to a characteristic of the subject improvement, the textile product of manufacture to be treated (which will be thereinafter denominated "fabric" for semplicity), is located on said conveyor in laps, obviously as it is possible to do so, that is, for example, as there are not involved the so-called moquettes, carpets, covers and the like.

According to a main characteristic or feature of the present invention, the fabric, as it is caused to advance in a horizontal or sub-horizontal plane (this condition and the effects thereof will be described in a more detailed way thereinafter) is stricken from the top by a plurality of liquid blades or jets as characteristically supplied under comparatively low pressures, for example of the order of 1 to 5 water column meters, and with comparatively high flow rates, for example 10 to 40 $mc^3$/hour per blade. The liquid which has impacted on the fabric descends or falls again into the bath and it is recirculated by means of a suitable pump and filter system, said filters or filtering means being effective to retain and remove the entrained solid materials.

The treating or processing is carried out, according to the known way, by using liquids as suitably heated to the proper temperature, depending on the nature of the used chemical compounds and/or the characteristics of the textile product of manufacture to be processed. By means of a suitable hetaing system, being preferably though not critically combined with the recirculating system, and comprising heat exchangers in turn associated with the recirculating system or circuit and possibly with the bath, and comprising control and temperature maintaining or holding means (such as thermostats driving or controlling the several components of the heating system), the circulating liquid, in particular the liquid of the liquid blades or jets, can be brought to and maintained at temperatures of the order, for examlpe, of 40°–50° C., as are carried out treatings on wool fabrics which have been already subjected to a printing processing with acid colouring agents, which temperatures, as it is well known, can be much higher, up to 98° C., as polyester fabrics or knitted articles are processed, during the so-called purging step or in the pre-processing step for the printing and/or the dyeing.

The characteristic use of liquid blades or jets under comparatively low pressures and comparatively high flow rates is particularly advantageous, inter alia, as the processing requires temperatures near to the water boiling temperature. The use of these liquids blades permits to have minimum losses in the temperature of the projected jets, as far as these latter hit on the fabric, to which conditions, obviously, contribute the closure of the possible thermal protection of the vessel or vessel systems providing in the inside thereof the treating environment.

In addition to the recirculating means and the means for replenishing the bath liquid, the treating or processing unit according to the invention comprises means for adjusting the bath level within suitable limits. Said level can be much lower than that of the of the bearing reach of the permeable conveyor: on the other hand it may also be much greater than that of said permeable conveyor, in such a way that the fabric is completely immersed in the liquid. However the liquid free surface has not to exceed, above said fabric, a level (for example of one or few centimeters) which is such as to deleteriously reduce the impact speed of said liquid blades on the fabric, to which impact is granted the function of providing the processing temperature and, mainly, the mechanical action of affecting the fibrous and/or hairy components which are present on the surface face of said textile product of manufacture.

In the case, which is practically the prevailing one, in which the fabric is set in laps on the conveyor, the mechanical action of these liquid blades assures a continuous variation and a repeated alternating of the positions of said fabric laps, which flaps are opened wide apart and shifted to the instantaneous lying position thereof, with a continuous substitution of the contact points between the liquid threads present in the liquid blade and the fabrics in laps, at the interfaces between the adjacent laps, in such a way that the blade liquid affects the overall surface of the fabric, through the laps thereof.

The aforesaid liquid blades or jets are emitted, under the flow rate and pressure conditions thereinabove indicated, through nozzles consisting of continuous slots, having advantageously a width effective to be adjusted depending on the desired impact flow rate and pressure, which slots extend through the overall width of the underlying conveyor, that is, practically, for the overall width of the textile product of manufacture to be open-width processed. Accordingly, the size of the slots emitting said liquid blades and of the conveyor depends on the size of the textile product of manufacture to be processed, the orthogonality between the direction of said slots and the afvancing direction of said textile product of manufacture being a condition which is not strictly critical but highly preferable in order to obtain the effects thereinabove stated.

In turn the active reach or portion of the permeable conveyor is generally disposed in the treating or processing environment according to a horizontal plane. Also this condition is not strictly critical and it is possible to provide that the conveyor has a certain slight slanting (possibly adjustable) with respect to the horizontal directions, for example in order to obtain a progressive variation on the treating or processing environment or field, either positive or negative, of the immersion of the material to be treated between the input to and output from said treating or processing field or environment.

Furthermore, the liquid blades can be projected through the slot jets in a direction equal to or different from 90° with respect to the vertical direction, more specifically with respect to the lying plane of the textile product of manufacture being processed, for example in order to selectively obtain a predeterminet directionality of the fluid impact, to assure better conditions in the shifting of the laps thereinabove cited, or predetermined impact directions in the case in which carpets, coverings or other "long pile" products of manufacture are treated or processed.

Obviously the treating or processing unit is completed by means for introducing and withdrawing the textile product of manufacture into/from the enclosed environment of the liquid bath and blades or jets. These means will be described in a more detailed way thereinafter, with reference to a specific embodiment of the invention.

These and other more specific characteristics of the present invention will become more apparent from the following detailed description of an exemplary not limitative embodiment of the invention, with reference to the accompanying drawing, where:

Figures 1, 2:
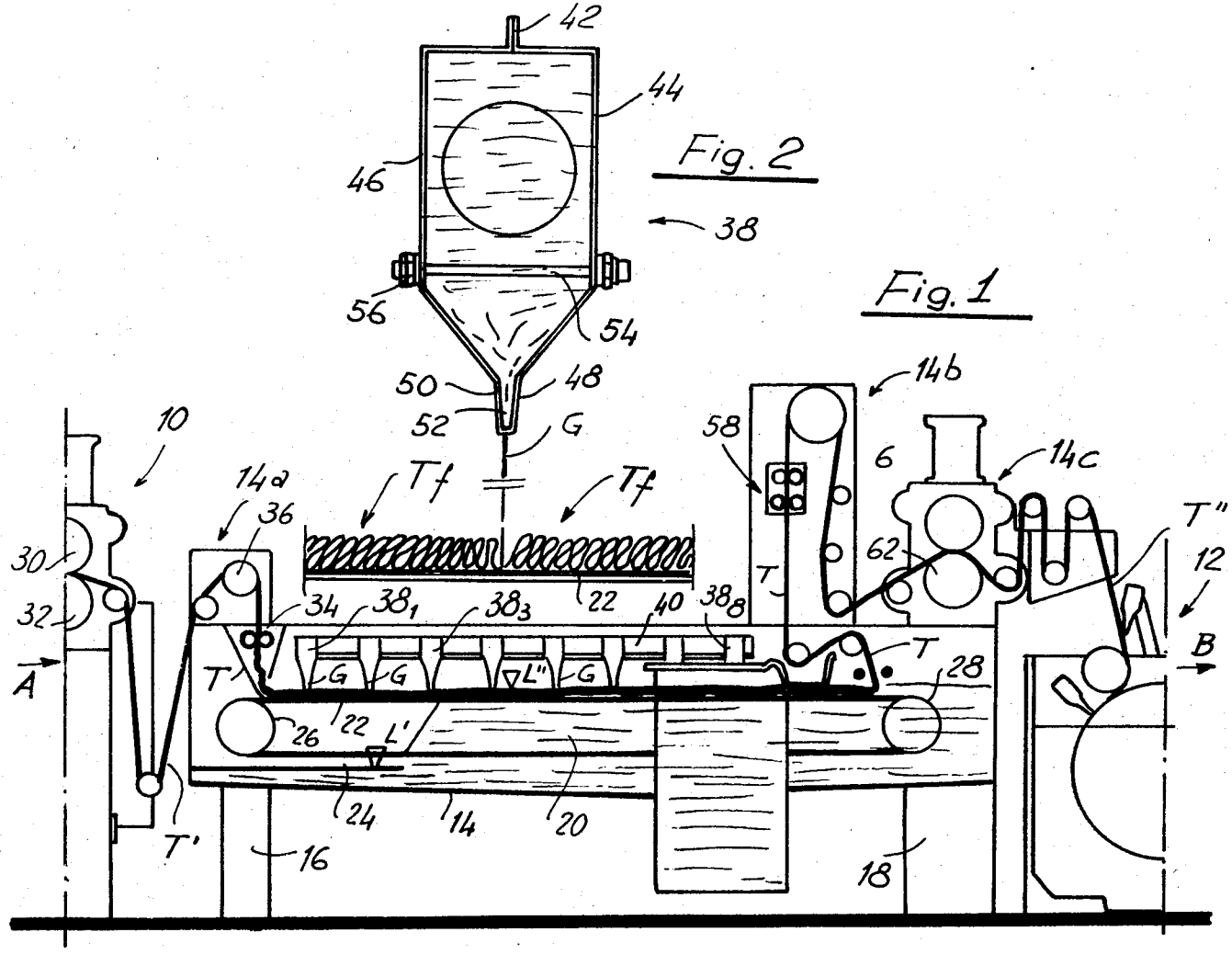
FIG. 1 is a vertical longitudinal cross-section schematic simplified view illustrating an improved treating or processing unit according to the present invention.
FIG. 2 is a like vertical cross-section view, on an enlarged scale, illustrating an exemplary embodiment of a structure including one of the means for emitting said liquid jets, and the effect deriving therefrom on an underlying advancing fabric as arranged in laps.

Referring particularly to the drawing figures, FIG. 1 illustrates the overall treating or processing unit as located downstream of an inlet unit 10, therefrom the fabric T' to be treated is supplied, and upstream of an output unit 12 thereinto the fabric T'' treated according to the invention is transferred or introduced, to be further treated, said upstream and downstream units 10 and 12 respectively being fragmentarily illustrated and not constituting a characteristic of the present invention. The fabric passes through the improved unit in the direction indicated overally at A–B.

Constructively, the treating or processing unit comprises a vessel 14, including several portions as thereinbelow indicated, as suitably supported by supporting members 16 and 18 and therein the liquid of the bath 20 is enclosed and caused to circulate. The treating or processing environment is provided in the inside of said vessel 14, the longitudinal dimension whereof determines the length of the treating field, the treating or processing time being determined by the time necessary for passing through, in the A-B direction, any points of the fabric T, on the active reach or portion of the conveyor, that is of the reach 22 of a permeable conveyor 24 as supported in closed loop between rollers or cylinders 26 and 28, at least one whereof being suitably driven.

The inlet fabric T', as exiting the upstream unit 10 through a squeezing cylinder pair 30,32 is supplied into the treating environment by introducing means as supported and enclosed by the portion 14*a* of the structure 14 enclosing the liquid bath 20 and comprising, preferably, sets or assemblies 34 of converging widening jets. In the case in which fabrics in laps Tf are processed (see the detail of FIG. 2) the entering fabric T, being soaked, is advanced, for example by a roller 36, with a predetermined linear speed, much less than that of the conveyor, for example from 20 to 80 times greater, these values being determined in the most convenient way in order to maximally exploit the capacity of the system, in particular the useful length of the bearing or supporting reach 22 of the conveyor, obviously compatibly with the possibilities of forming the laps and treating the fabric in this form.

The liquid bath 20 can be maintained at different levels, for example between a lower level L' with respect to the conveyor and a higher level L'' with respect to the carrying reach 22 of said conveyor, within the limits therein above indicated in order to prevent the laminar jets or blades G as emitted from corresponding jet emitting devices $\mathbf{38}_1,\mathbf{38}_2,\mathbf{38}_3 \ldots \mathbf{38}_8$ from being "dampened", the number of said jet emitting devices depending on the needs and efficiency of the treating, and experimentally verified.

Advantageously each said jet emitting device 38 is arranged as it is indicated in FIG. 2 and it comprises an elongated hollow body, as located transversely with respect to the conveyor belt and thereabove, between hollow members 40 (FIG. 1) acting as supporting members or supply headers for the jets G. Said hollow body is advantageously formed by oppositely locating and connecting at 42 two half-symmetrical bodies 44 and 46 the lower ends whereof 48 and 50 are adjoining but not into contact, in such a way as to form therebetween a nozzle 52 of the continuous slot type, effective to emit the jet or liquid blade G against the underlying textile product of manufacture (not necessarily in laps), as supported and advanced by the upper reach 22 of the conveyor 24.

By means of a plurality of cross members effective to be adjusted by acting for example on respective nuts 56, the distance between the portions 48 and 50, and accordingly the passage distance for the slot nozzle 52, can be adjusted, as well as it is possible to control and correct the uniformity of said distance, through the overall jet width.

Because the treated textile product of manufacture may shrink or possibly extend, as it really does, during a wet or hot treating, at the end portion of the treating field or environment on the conveyor carrying reach 22 there are provided mechanical or optic sensing members effective to detect the fabric laps at the output of said treating field. The signal from said sensing members or devices is indicative of the fabric shrinking or elongation, and it is used for driving or controlling the actuating speed (by means of suitable motors or reducing units effective to provide a continuously variable speed) of the rollers or cylinders present in the system of the withdrawing means provided in the portions 14*b* and 14*c* of the bath vessel, which portions completely communicate at the bottom with the lower main portion 14, in order to convey into said liquid bath 20 the excess entrained liquid, the output speed being adjusted in such a way that the fabric T″ emitted by the treating or processing unit is in its most suitable natural position, as practically determined by the weight of said material, for successively transferring and processing of said material in the downstream members 12 and subsequent treating members of the system.

By passing through the end portions towards the output of the treating unit, the fabric T engages centering-widening jet means 58, included in the portion 14*b* and, finally a "foulard" or output squeezing end system comprising a known pair of rollers 60 and 62, rotating in opposite directions, and generally rubber covered, the bath excess liquid, present in the outputting material, falling again into the underlying bath 20, to be recirculated.

While the improved method and means according to the invention for obtaining a maximum efficiency in the steps for the continuous and open-width washing of fabrics have been thereinabove described only as an indicative but not limitative example, it should be noted that they are susceptible to several modifications and variations, depending on the specific needs and constructional exigences, as well as on the practical experience; without departing from the scope of the invention, as it is defined in one or more of the accompanying claims.

I claim:

1. An improved system for the continuous and open-width washing, after the printing and/or purging and bleaching, of a fabric, which comprises permeable means for conveying said fabric through a treating and/or processing vessel under thermally controlled conditions, a bath having an inlet portion and chemical agents effective to provide the treating and/or processing operations enclosed in said vessel, means for recirculating the liquid in said bath, means for introducing the liquid into the bath in the form of jets above said fabric, said means for recirculating the liquid comprising a continuous slot nozzle assembly forming a recirculating circuit; said permeable conveying means including a liquid permeable circulating conveyor belt; and including means for introducing the fabric at a level above the inlet portion of said bath and means for supplying said fabric with a speed much greater than the advancing speed of said conveyor means, whereby laps in said fabric are formed; said means for introducing the liquid into the bath in the form of jets above said fabric including a plurality of jet emitting devices each supplied with said liquid and disposed to have a liquid flow rate between 10 and 40 cubic meters per hour at a pressure between 1 and 5 meters water column, and positioned above said conveyor belt in substantially unobstructed relation to the laps of said fabric carried on the conveyor belt, each jet emitting device emitting a liquid blade type jet extending transversely to the movement path of the conveyor belt, the liquid free surface of the bath above the fabric not exceeding a few centimeters.

2. The system according to claim 1 wherein said nozzle assembly consists of nozzles formed of a hollow body, said hollow body being formed of two members having parallel walls, connected at the upper end and inclined towards each other at the lower end to form a slot and including means for adjusting the distance between said members at the lower end whereby the size of said slot is adjusted.

3. The system according to claim 1 which comprises output means for removing the fabric at the output end opposite to the inlet end, means for withdrawing said fabric from said output end, said withdrawing means comprising at least a rubberized roller pair effective to squeeze out the excess liquid from the processed fabric and wherein said withdrawing means are associated with centering-widening jet systems effective to assure the open-width condition of said fabric and to correct the centered position of said fabric before the withdrawal of said fabric.

* * * * *